US009796464B1

(12) United States Patent
Sand

(10) Patent No.: US 9,796,464 B1
(45) Date of Patent: Oct. 24, 2017

(54) HUMAN DRIVEN WATER PROPULSION DEVICE

(71) Applicant: Keith Sand, Calgary (CA)

(72) Inventor: Keith Sand, Calgary (CA)

( * ) Notice: Subject to any disclaimer, the term of this patent is extended or adjusted under 35 U.S.C. 154(b) by 0 days.

(21) Appl. No.: 15/368,068

(22) Filed: Dec. 2, 2016

(51) Int. Cl.
*B63B 35/74* (2006.01)
*B63H 16/18* (2006.01)
*B63H 1/14* (2006.01)
*B63H 23/34* (2006.01)

(52) U.S. Cl.
CPC ..... *B63H 16/18* (2013.01); *B63B 35/74* (2013.01); *B63H 1/14* (2013.01); *B63H 23/34* (2013.01); *B63H 2016/185* (2013.01)

(58) Field of Classification Search
CPC ..... B63B 35/74
USPC ..... 440/25
See application file for complete search history.

(56) References Cited

U.S. PATENT DOCUMENTS 381,160 A * 4/1888 Moon ..... B25B 15/06 123/195 HC
552,910 A * 1/1896 Kimball ..... B25B 15/06 74/127
1,321,267 A * 11/1919 Wilson ..... B63H 16/14 440/31
3,643,619 A 2/1972 Nicholson
4,878,864 A * 11/1989 Van Bentem ..... B63H 20/08 440/5
5,413,066 A * 5/1995 Spencer, Jr. ..... B63B 7/082 114/354
5,643,020 A * 7/1997 Harris ..... B63H 16/14 440/31
5,651,706 A * 7/1997 Kasper ..... B63B 7/082 114/354
5,743,772 A * 4/1998 Assawah ..... B63H 16/14 440/28
6,146,218 A * 11/2000 White ..... B63H 16/14 114/61.15
6,241,565 B1 * 6/2001 Doroftel ..... B63H 16/14 440/21
7,662,005 B2 * 2/2010 Provost ..... B63H 5/125 440/53
7,887,381 B2 * 2/2011 Brass ..... B63B 35/71 114/347
2008/0096447 A1 * 4/2008 De Masi ..... B63H 20/12 440/53

* cited by examiner

*Primary Examiner* — Lars A Olson
*Assistant Examiner* — Jovon Hayes
(74) *Attorney, Agent, or Firm* — Stephen Lewellyn

(57) ABSTRACT

A human driven water propulsion apparatus includes a propeller and a human powered drive coupled to the propeller for driving the propeller. The propeller and human powered drive are connected to and supported by a chassis. Foot pedals are slidably engaged with the helical drive shafts. The helical drive shafts are connected to the propeller through one-way clutches and a gear train such that the propeller is driven by the helical drive shafts when driven by the pedals. In a watercraft application, the chassis is rotatably mounted for rotation between a first position where the propeller is faced in a forward direction and a second position where the propeller is faced in a rearward direction. In a swimmer application, a seat is attached to the chassis by a seat post and straps secure the seat to a user.

12 Claims, 11 Drawing Sheets

HUMAN DRIVEN WATER PROPULSION DEVICE

FIELD OF THE INVENTION

The present invention relates generally to human driven propulsion of watercraft, and more particularly, relating to a human driven water propulsion apparatus that can be used in connection with a personal watercraft primarily used for recreational and fishing purposes.

BACKGROUND OF THE INVENTION

Human powered personal watercrafts are known and are popular for fishing and recreational activities. Depending upon the type of watercraft various forms of human powered devices may be used for propulsion. Oars, for example, are a commonly used with lightweight watercrafts such as pontoons, kayaks, canoes and the like. Oars can be cumbersome and difficult to operate depending on the type of watercraft and when engaged in certain activities such as fishing. As an example, when fishing at some point the watercraft will be headed in an undesirable direction while a fish is on the line at the same time, thereby require a user choose between handling the fishing rod or the oars.

In addition, oars are not suitable for use with certain watercraft such as fishing float tubes because float tube designs make operating oars nearly infeasible. Since oars are not particularly useful with fishing float tubes, foot worn flippers are most commonly used with this type of watercraft. While flippers generally work to propel a float tube, they have many drawbacks and disadvantages. For instance, flippers can only be used to propel the float tube in a single direction that is opposite from which the user is facing while seated on the float tube. Further flippers can be exhausting to use for extended periods and prolonged use can cause soft tissue injuries, such as, for example Illiotibial Band Syndrome as referred to as "Swimmer's Heel." Divers and swimmers that use flippers can also develop soft tissue injuries.

Another human powered watercraft is paddle boat that generally includes two pedals that are operatively connected to one or more paddle wheels that are driven when a user drives the pedals in a rotary motion. Paddle boats are commonly used in short durations on calm water and are not particularly useful for fishing. In addition, the paddle wheel propulsion system is integrated into the paddle boat and cannot be removed and transferred to another watercraft type.

In view of the foregoing drawbacks and disadvantages in existing human driven water propulsion devices, a need exists for a new human driven propulsion device that is hands-free and can be easily attached to different types of watercrafts.

SUMMARY OF THE INVENTION

In carrying out principles of the present invention, in accordance with an embodiment thereof, a human driven water propulsion apparatus is provided as an accessory for attachment to existing personal watercrafts, such as, for example, fishing float tubes and pontoon boats.

In general, in one aspect, a human driven water propulsion device for attachment to a watercraft is provided. The propulsion device includes a propeller and a human powered drive coupled to the propeller for driving the propeller. The propeller and human powered drive are connected to and supported by a chassis. The chassis rotatably mounted for rotation between a first position where the propeller is faced in a forward direction and a second position where the propeller is faced in a rearward direction.

In accordance with an aspect of the present invention, the human powered includes a first helical drive shaft, a first foot pedal slidably engaged with the first helical drive shaft, a second helical drive shaft, and a second foot pedal slidably engaged with said second helical drive shaft. The helical drive shafts are connected to the propeller by a pair of one-way clutches and a gear train such that the propeller is driven by the helical drive shafts when driven by the pedals.

In carrying out principles of the present invention, in accordance with an embodiment thereof, a human driven water propulsion apparatus that can be used by a swimmer or diver to propel the user through the water without using flippers.

In general, in an aspect, a human driven water propulsion device for use by a swimmer has a propeller and a human powered drive coupled to the propeller for driving the propeller. The propeller and human powered drive are connected to and supported by a chassis. A post is connected at a first end to the chassis and extends outwardly therefrom where a seat is connected to a second end of the post.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there are illustrated embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
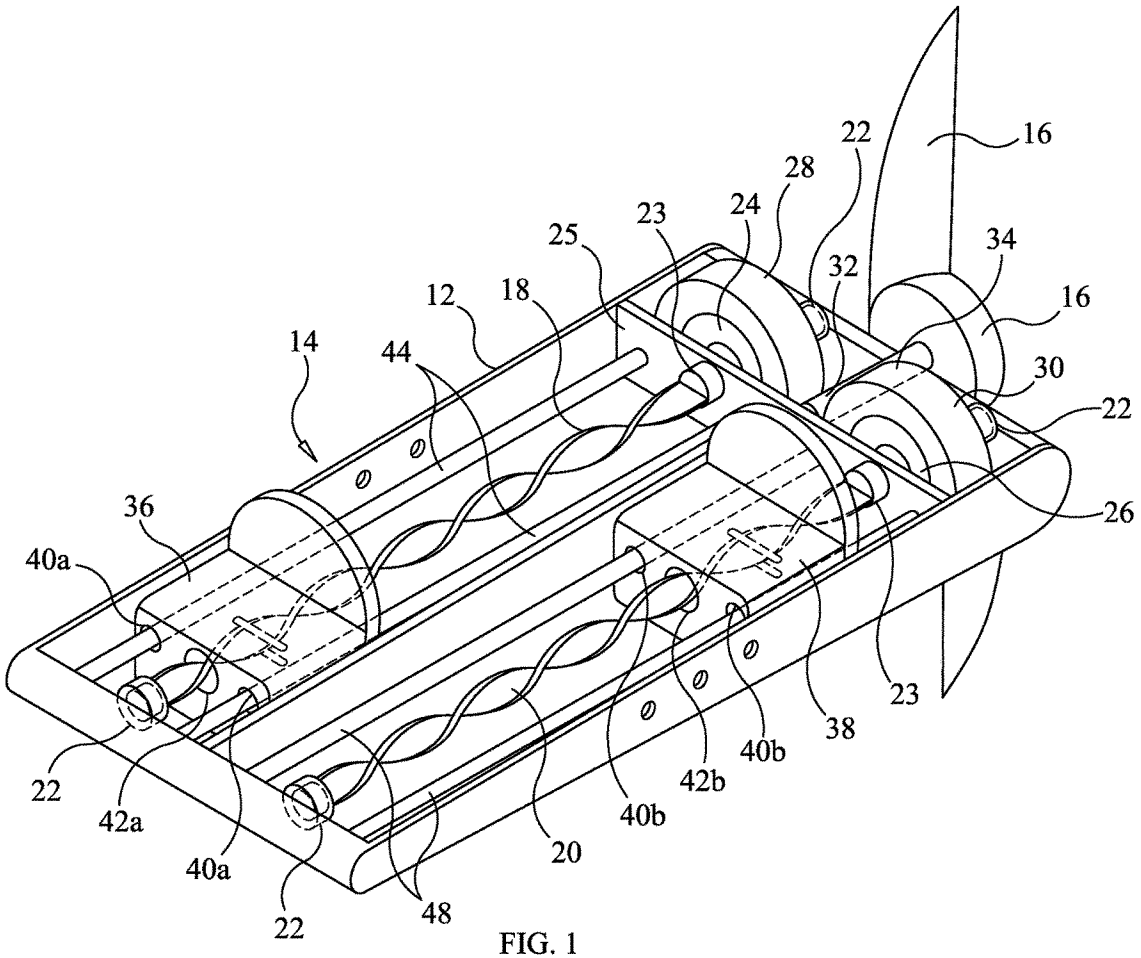
FIG. 1 is a perspective, diagrammatic view of a human driven water propulsion device constructed in accordance with principles of the present invention.
Figure 2:
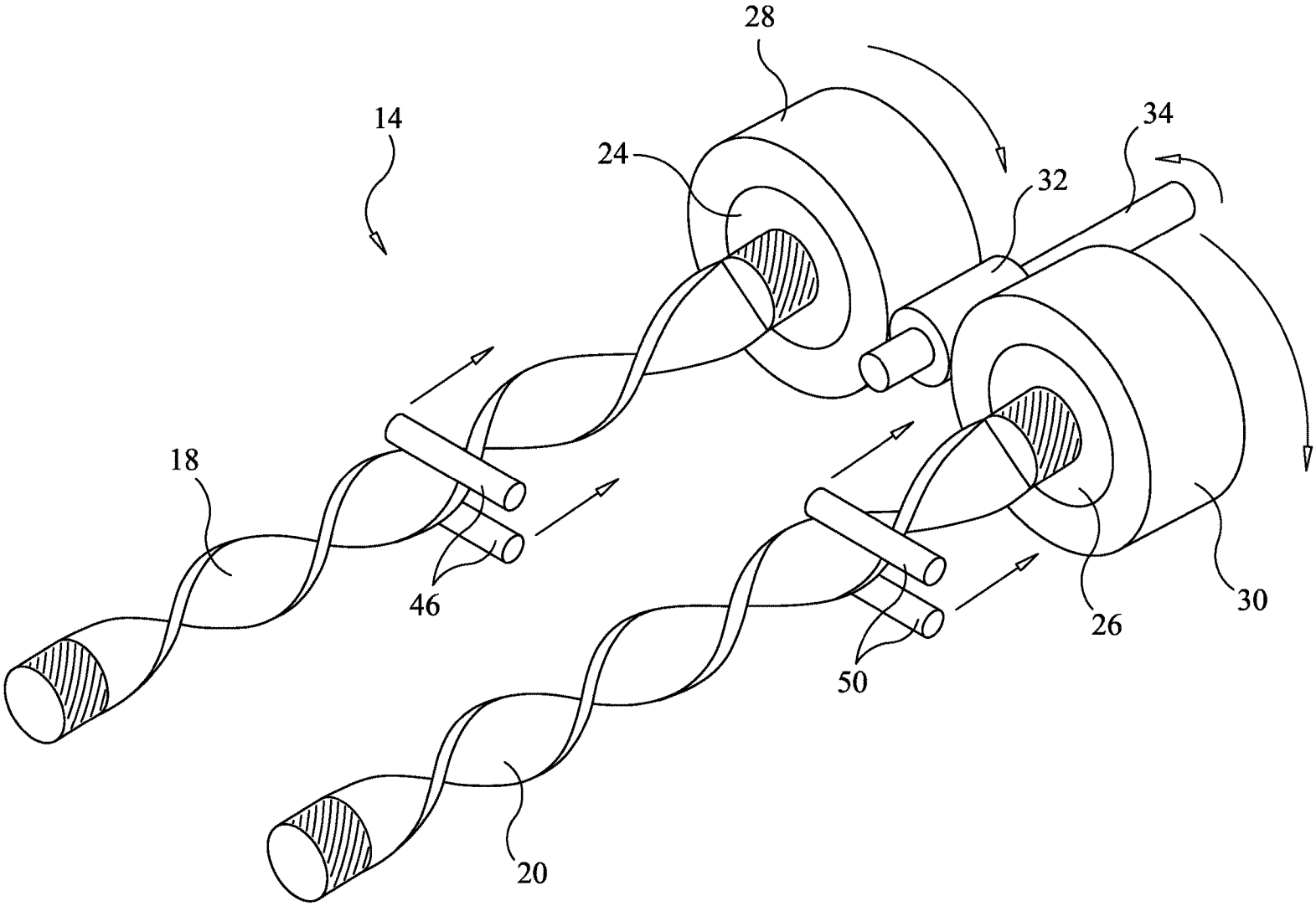
FIG. 2 is a diagrammatic, simplified view of the human driven water propulsion device that is illustrated in FIG. 1.

Referring initially to FIGS. 1 and 2, the human driven propulsion device 10 includes a chassis 12 that serves to support a drive assembly 14 and a propeller 16 that is operatively connected to and driven by the drive assembly.

The drive assembly 14 includes a pair of helical drive shafts 18 and 20 that are disposed in a side-by-side relationship and supported at their opposite ends by bearings 22 for rotation about their respective longitudinal axis. Each bearing 22 is attached to and supported by the chassis 12. Drive shafts 18 and 20 are also supported at an intermediate location along their lengths by bearings 23 that are supported by a transverse cross member 25 of chassis 12. An end of each helical drive shaft 18 and 20 is drivingly connected to a one-way roller clutch 24 and 26, respectively. Clutch 24 rotates with helical drive shaft 18 in one rotary direction and free-wheels in the other direction. Similarly, clutch 26 rotates with helical drive shaft 20 in one rotary direction and free-wheels in the other direction. Drive gear 28 is coaxially connected to clutch 24 and drive gear 30 is coaxially connected to clutch 26. Drive gears 28 and 30 mesh with driven gear 32. Driven gear 32 is connected to and rotates propeller drive shaft 34, which in turn is connected to and rotates propeller 16. While not shown, propeller drive shaft 34 is rotatably supported by bearings located at opposite ends of the shaft.

Drive assembly 14 further includes a pair of foot pedals 36 and 38. As described in further detail below, foot pedals 36 and 38 are operatively engaged and rotate helical drive shafts 18 and 20, respectively, which ultimately drives propeller 16.

Figure 12:
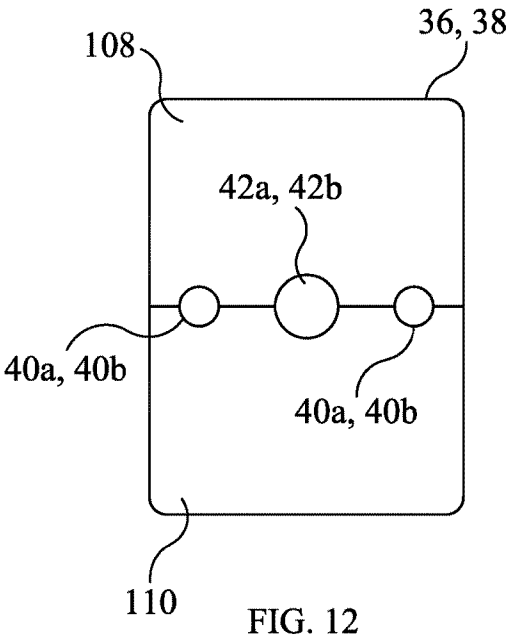
FIG. 12 is a second end view of the foot pedal.
Figure 11:
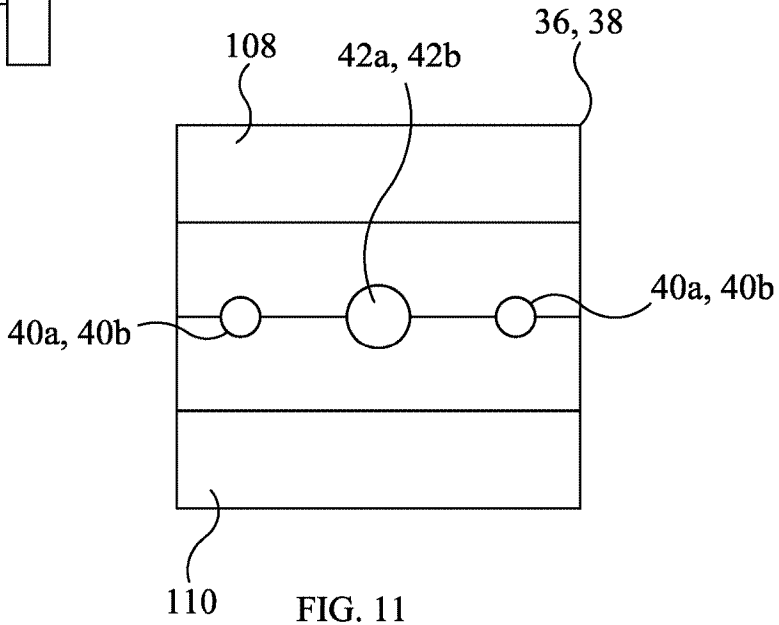
FIG. 11 is a first end view of the foot pedal.
Figure 10:
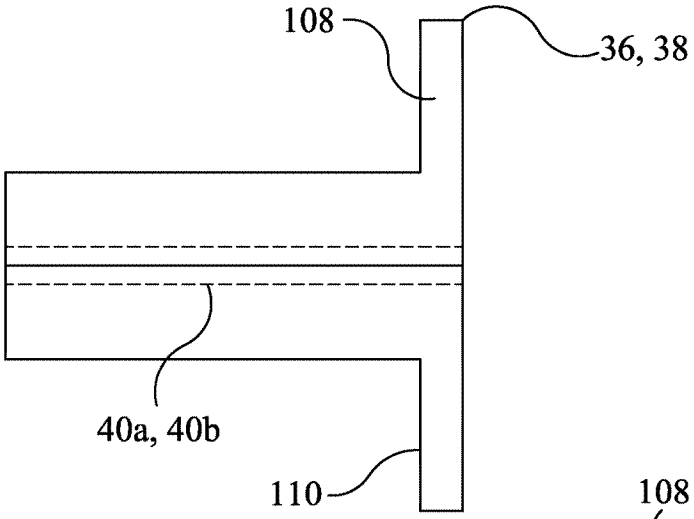
FIG. 10 is a side view of a foot pedal.

Foot pedal 36 includes a pair of guide rail passages 40*a* and a drive shaft passage 42*a* each of which extend longitudinally through the foot pedal (FIGS. 10-12). Guide rails 44 are connected to chassis 12 and are disposed along opposite sides of helical drive shaft 18. Guide rails 44 extend through guide rail passages 40*a* and the helical drive shaft 18 extends through drive shaft passage 42*a*. Guide rails 44 slidingly support foot pedal 36 for rectilinear motion back-and-forth along the helical drive shaft 18. Foot pedal 36 is operatively engaged with helical drive shaft 18 to rotate the shaft when the pedal is moved back-and-forth.

This engagement is provided by a pair of rollers 46 that are supported by the foot pedal 36 and are oriented crosswise to the drive shaft passage 42*a*. The helical drive shaft 18 extends between rollers 46 with the rollers engaged with the wide sides of the helical drive shaft. When the foot pedal 36 is moved in a first rectilinear direction along the helical drive shaft 18, the helical drive shaft is forced to rotate in a first rotary direction that causes clutch 24 to engage and rotate gear 28. When the foot pedal 36 is moved in the opposite rectilinear direction, the helical drive shaft 18 is forced to rotate in the opposite rotary direction causing the clutch to disengage and free-wheel.

Similar to foot pedal 36, foot pedal 38 includes a pair of guide rail passages 40*b* and a drive shaft passage 42*b* each of which extend longitudinally through the foot pedal (FIGS. 10-12). Guide rails 48 are connected to chassis 12 and are disposed along opposite sides of helical drive shaft 20. Guide rails 48 extend through guide rail passages 40*b* and the helical drive shaft 20 extends through drive shaft passage 42*b*. Guide rails 48 slidingly support foot pedal 38 for rectilinear motion back-and-forth along the helical drive shaft 20. Foot pedal 38 is operatively engaged with helical drive shaft 20 to rotate the shaft when the pedal is moved back-and-forth.

This engagement is provided by a pair of rollers 50 that are supported by the foot pedal 38 and are oriented crosswise to the drive shaft passage 42*b*. The helical drive shaft 20 extends between rollers 50 with the rollers engaged with the wide sides of the helical drive shaft. When the foot pedal 38 is moved in a first rectilinear direction along the helical drive shaft 20, the helical drive shaft is forced to rotate in a first rotary direction that causes clutch 26 to engage and rotate gear 30. When the foot pedal 38 is moved in the opposite rectilinear direction, the helical drive shaft 20 is forced to rotate in the opposite rotary direction causing the clutch to disengage and free-wheel.

A feature of the drive assembly is that the foot pedals 36 and 38 can be driven independently from one another. This means the foot pedals can be driven concurrently in the same rectilinear direction or driven in succession in opposite rectilinear directions. Further, since the foot pedals are independently operable, the propeller 16 can be driven by a user with only a single foot pedal.

Figure 3:
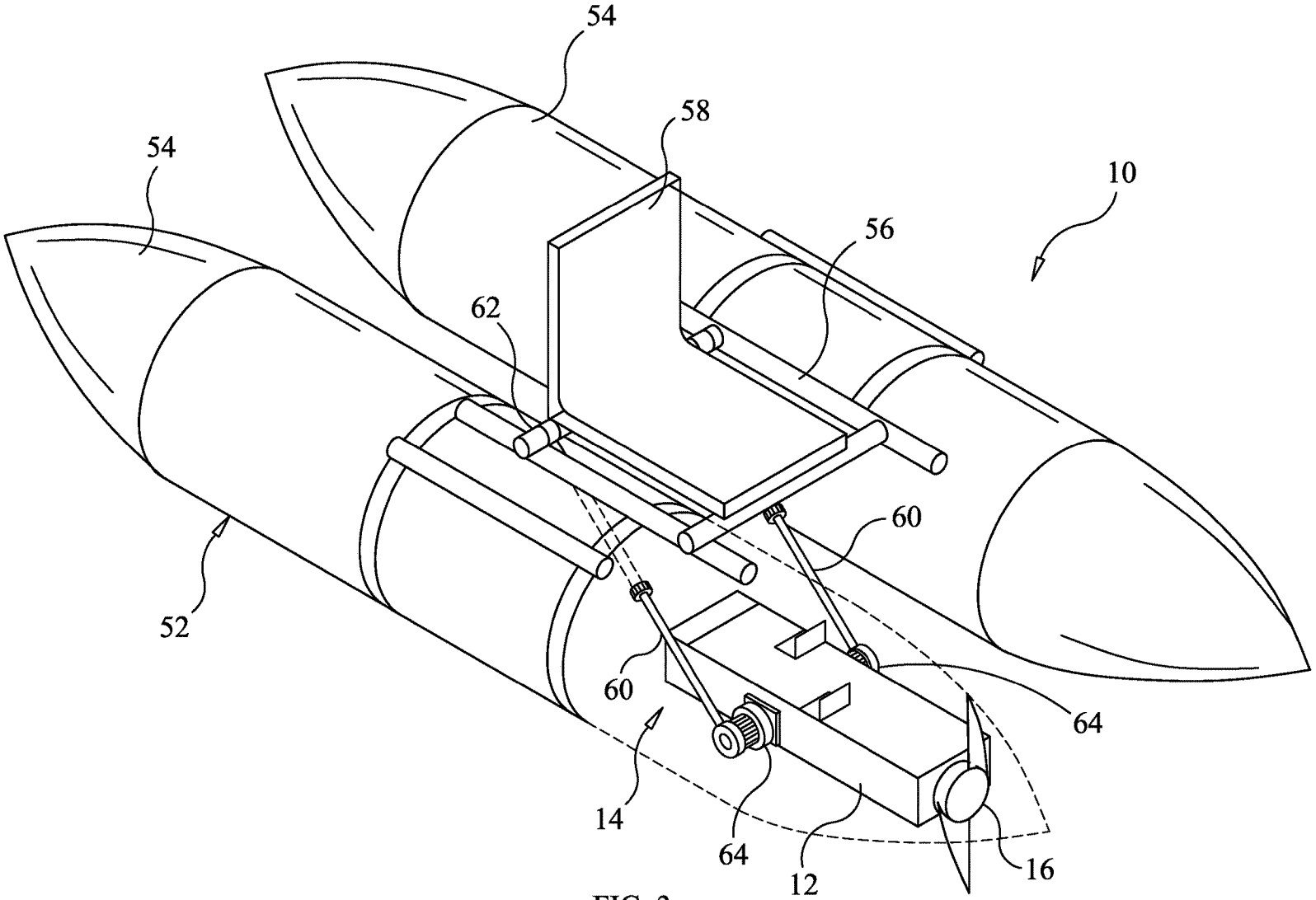
FIG. 3 is perspective view of a human driven water propulsion device constructed in accordance with the principles of the present invention in-use with a pontoon boat, the forward end of the right pontoon is shown in broken line for clarity.
Figure 4:
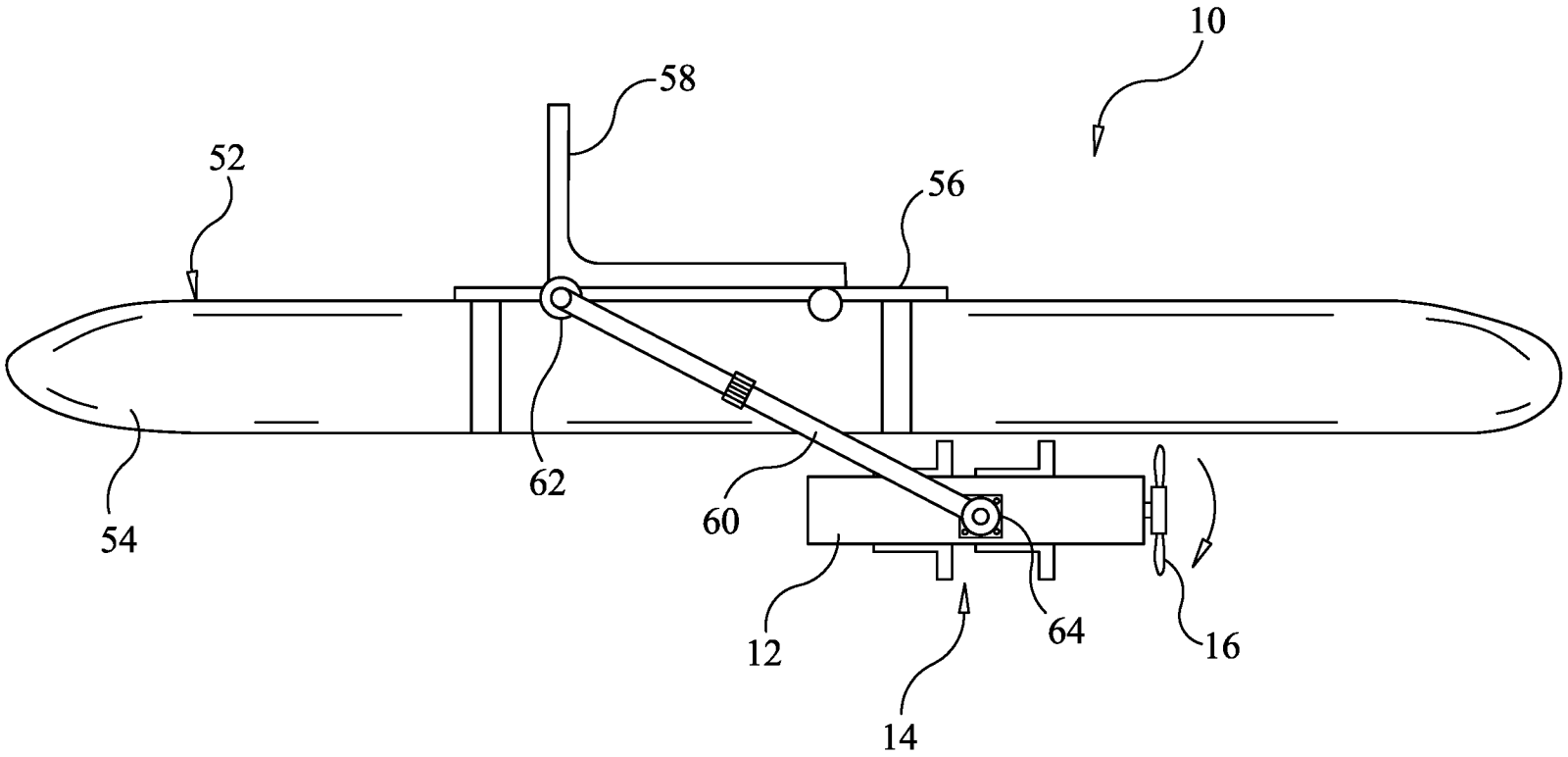
FIG. 4 is a side view of a human driven water propulsion device in-use with a pontoon boat and in a first position, the right pontoon is removed for clarity.
Figure 5:
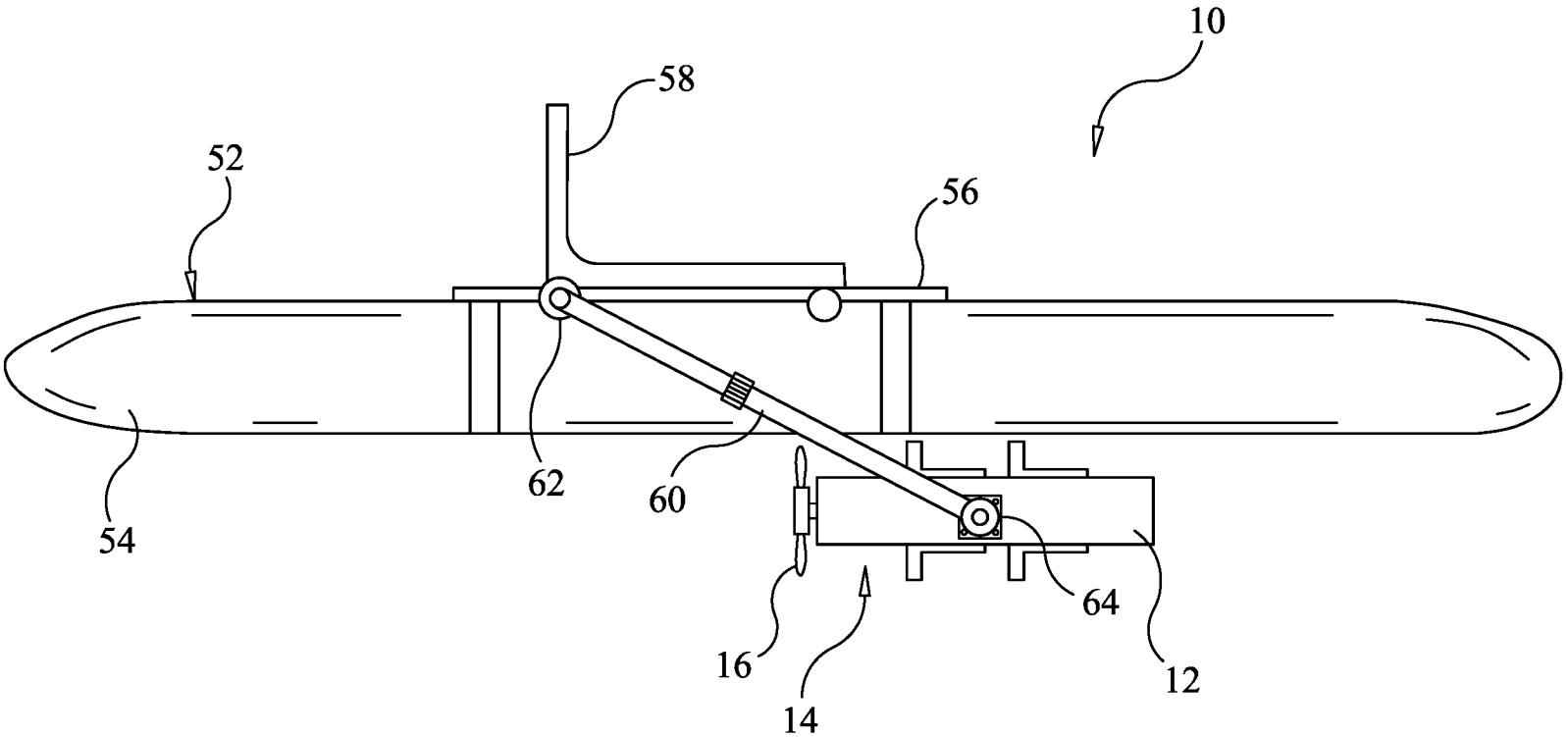
FIG. 5 is a side view of a human driven water propulsion device in-use with a pontoon boat and in a second position, the right pontoon is removed for clarity.

With reference to FIGS. 3-5, the propulsion device 10 is shown in-use and connected to a watercraft, representatively illustrated as a personal pontoon boat 52, which is commonly used for fishing. As shown, pontoon boat 52 includes a pair of pontoons 54, a seat frame 56, and a seat 58. The seat frame 56 connects the pontoons 54 and supports the seat 58. As further shown, the propulsion device 10 includes a pair of support arms 60 that connect the chassis 12 to the boat 52. More particularly, the support arms 60 are each connected at one end to a transvers frame member 62 of seat frame 56 and on opposite sides of seat 58. The opposite ends of the support arms 60 are connected to opposite sides of the chassis 12.

As described in further detail below, the support arms 60 are connected to the chassis 12 by rotational joints 64. The rotational joints permit the chassis to rotate between first and second operative positions. In the first operative position, FIG. 4, the propeller 16 is disposed in a forward position relative to the boat 52. In the second operative position, FIG. 5, the propeller is disposed in a rearward position relative to the boat 52. In the first position, the propeller 16 drives the boat in a rearwardly direction, and in the second position, the propeller 16 drives the boat in a forwardly direction.

Figure 6:
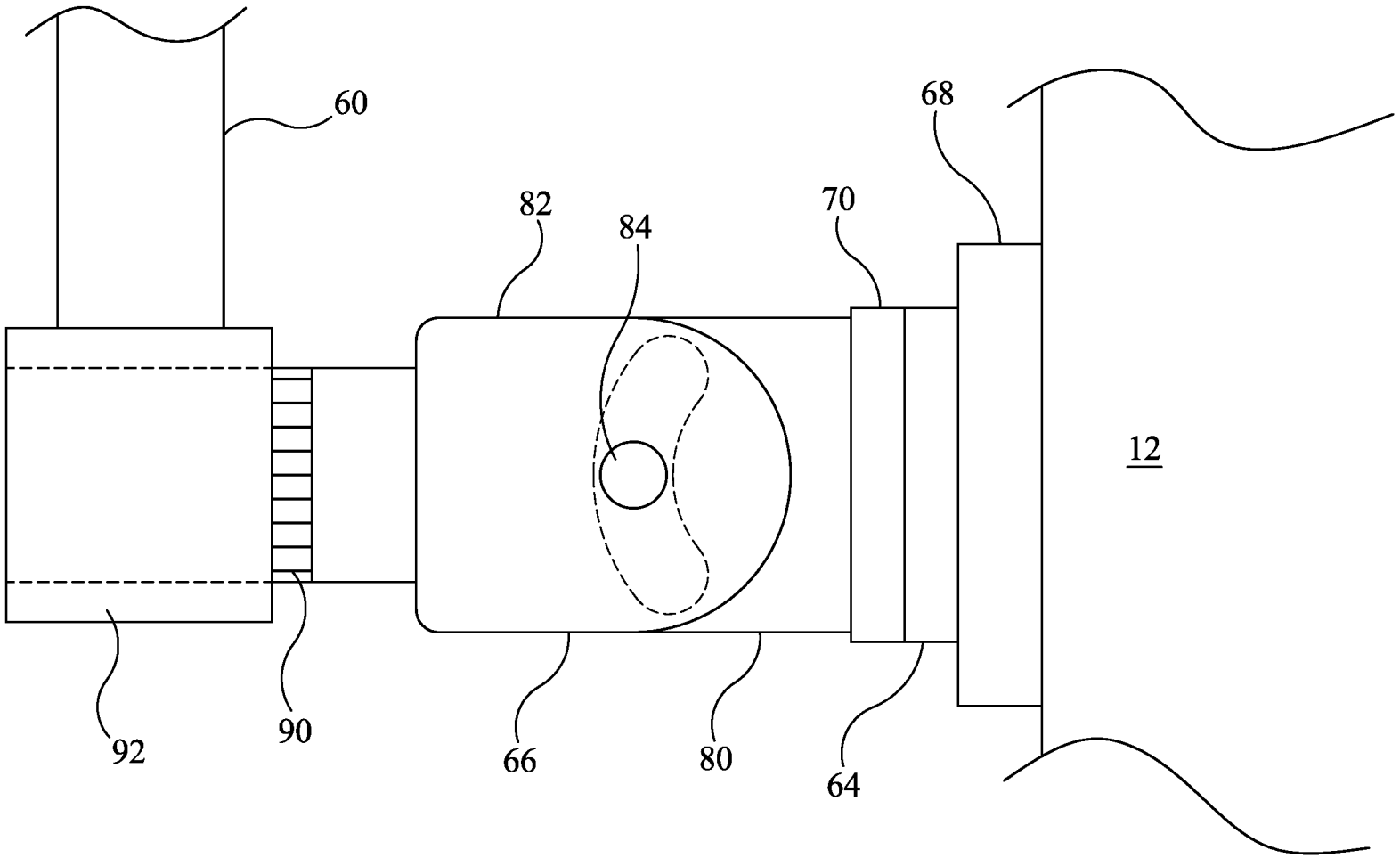
FIG. 6 is an enlarged, simplified top view of rotational joint and pivot joint connecting a support arm to a chassis of the human driven water propulsion device.
Figures 7, 8:
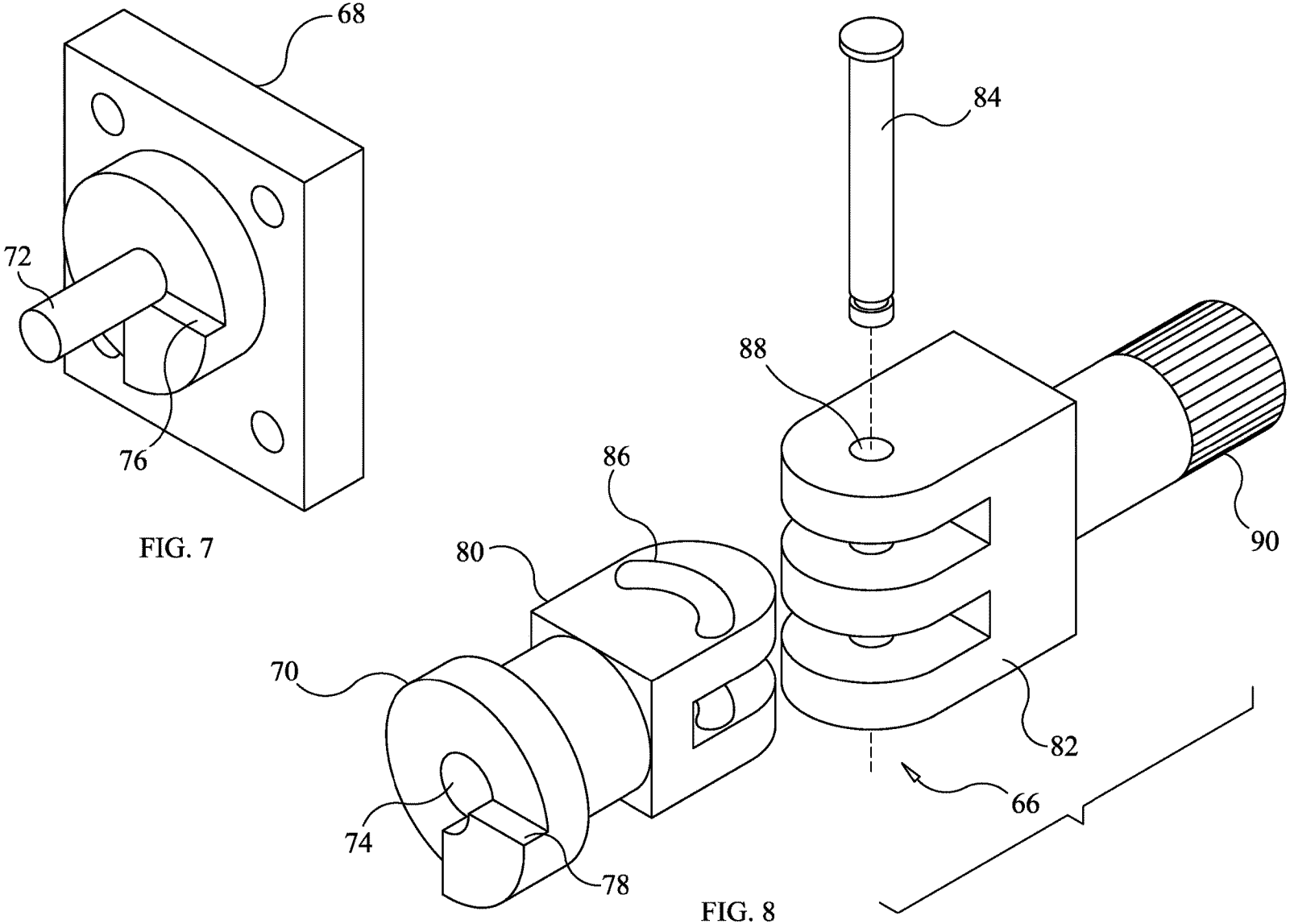
FIG. 7 a perspective view of first member of a rotational joint.
FIG. 8 is a perspective view of a second member of a rotational joint and a pivot joint shown in an exploded assembly view.

With reference to FIGS. 6-8, a rotational joint 64 and a pivoting joint 66 are illustrated. As illustrated, rotational joint 64 includes first joint member 68 and a second joint member 70 that are rotatably coupled together by a stem 72 that is received by a corresponding bore 74. Further each member 68 and 70 include cooperating shoulders 76 and 78 that limit rotation of joint 64 to through a 180-degree rotation.

As further shown, the support arm 60 is coupled to the rotational joint 64 by a pivoting joint, representatively shown as knuckle joint 66. The knuckle joint 66 includes an eye member 80 and a fork member 82 that are pivotally connected together by a pin 84 that is disposed through cooperating bores 86 and 88. Bore 86, formed through the eye end 80 is semi-circular shaped. The eye member 80 of the knuckle joint is connected to member 70 of the rotational joint 64 and a spline 90 is connected to extends outwardly from the fork member 82 of the knuckle joint 66. The end of the support arm 60 is fitted with a hub 92 configured to connected to spline 90. Each knuckle joint 66, having semi-circular bore 86, permit the chassis 12 to rotate side-to-side to change the direction of thrust of the propeller 16 to steer the boat.

Figure 9:
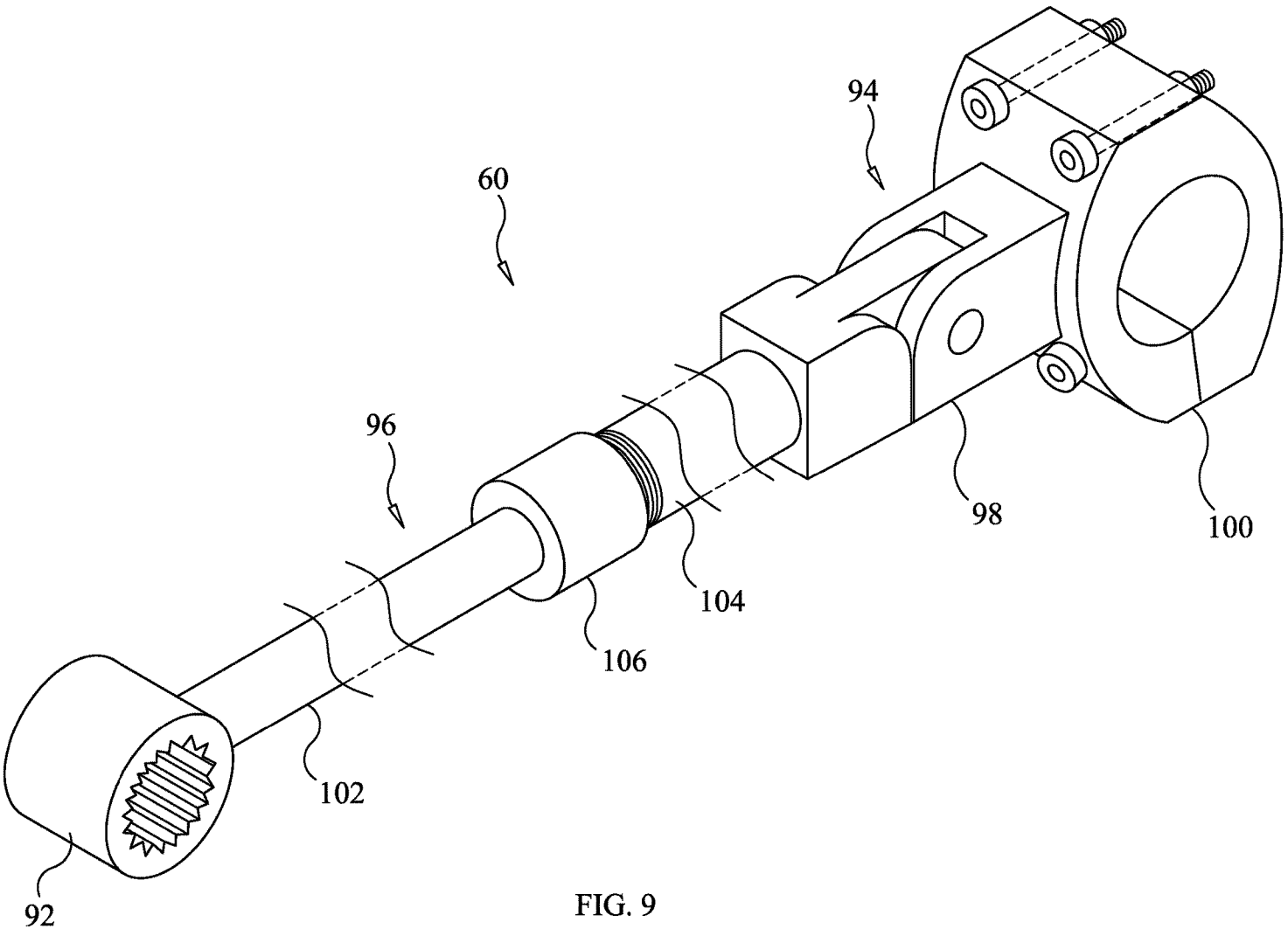
FIG. 9 is a perspective view of a support arm.

Turning now to FIG. 9, there is illustrated a support arm 60. The support arm includes an upper arm member 94 and a lower arm member 96 that are pivotally connect to one another by an elbow joint 98. The elbow joint 98 limits rotation between the upper and lower arm members 94 and 96 through a 90-degree rotation, which is upward relative to the boat to which the support arm is attached. The upper arm member 94 has a clamp 100 that is configured to clamp to the frame member 62 of seat frame 56. The lower arm member 96 is telescopic so as to adjust its length and includes a first tubular member 102 slidingly received by a second tubular member 104. The length of extension of the first tubular member 102 from the second tubular member 104 is locked by pole clamp 106. As further illustrated, spline hub 92 is connected to the end of the first tubular member 102 opposite of the pole clamp 106.

With reference to FIGS. 10-12, foot pedals 36 and 38 are illustrated. As shown, each foot pedal 36 and 38 has an identical construction including guide passages 40*a*, 40*b* and drive shaft passage 42*a*, 42*b*. As further illustrated, a feature of the present invention is that each foot pedal 36 and 38 is double-sided, thereby providing a foot engagements 108 and 110 on opposite sides of the foot pedal, which allows a user to operate the pedal when the chassis 12 is in either the first or second positions, shown in FIGS. 4 and 5, respectively.

In operation, user will adjust the length of the lower arm member 96 and clamp the upper arm member 94 by clamp 100 onto the rear cross-bar 62 of the seat frame 56 at an angle at which will set the chassis 12 under the user's feet. The spline 90 will fit into the hub 92 which keeps it from rotating since the teeth lock together. This will keep the chassis 12 a horizontal plane.

When the watercraft is to move backwards, the propeller 16 is at the front with the chassis 12 in the first position and the user will place their feet on the foot pedals 36 and 38 with the toes butted up against foot engagement 108. Straps (not shown) on the foot pedals 36 and 38 will wrap over the user's feet to prevent their feet from slipping off. When the watercraft 52 is to move forward the chassis 12 will be flipped over into the second position so the propeller 16 is at the back and the user will place their feet on the pedals 36 and 38 with the heels butted up against foot engagement 110. The straps will wrap over the user's feet to prevent their feet from slipping off.

The user will use a kicking motion with their leg at the knee while their thigh remains stationary on the seat. To propel backwards the propeller 16 is in front and the user will push the foot pedals 36 and 38 forward to transfer the torque through the one-way clutches 24 and 26 and gears 28 and 30 to the propeller 16. To move forward the chassis 12 is flipped over so the propeller 16 is behind it and the user will pull the pedals 36 and 38 back with their feet to transfer the torque through the one-way clutches and gears to the propeller.

Figure 13:
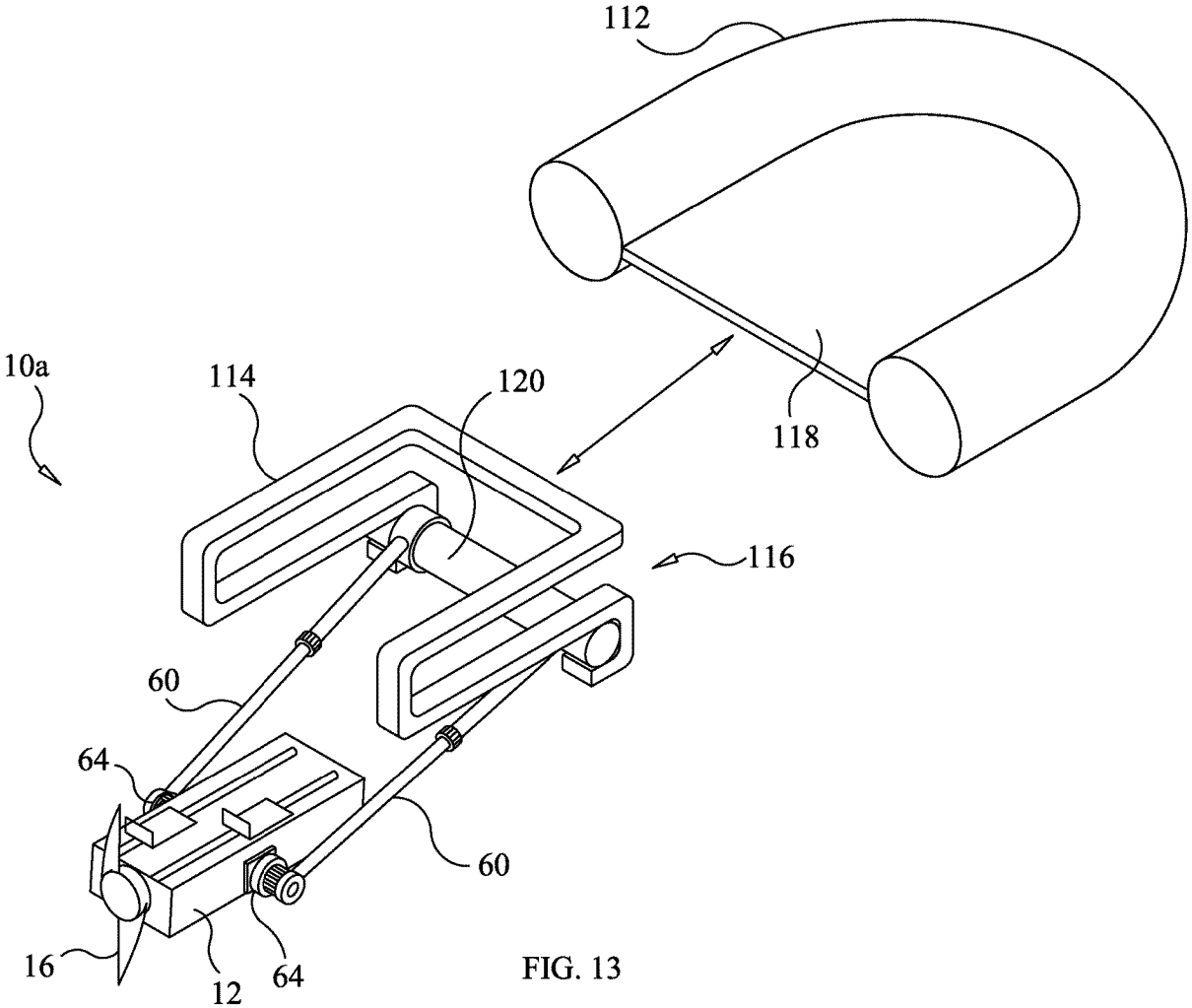
FIG. 13 is a perspective view of a human driven water propulsion in connection with a fishing float tube.

Turning now to FIG. 13, there is illustrated alternate embodiment 10*a* of the propulsion device that is configured for us with a fishing float tube 112. The propulsion device 10*a* is substantially identical to the propulsion device 10, but has a different seat frame 114 that is configured to mount to the float tube 112. The seat frame 114 is constructed so as to have a folded-over construction providing a rearwardly facing opening or space 116 between the frame members into which is removably receivable the seat portion 118 of the float tube 112. The support arms 60 are connected to transverse frame member 120 of the seat frame 114 in the same manner as described above. A seat, not shown for clarity, would be attached to the seat frame 114.

Figure 14:
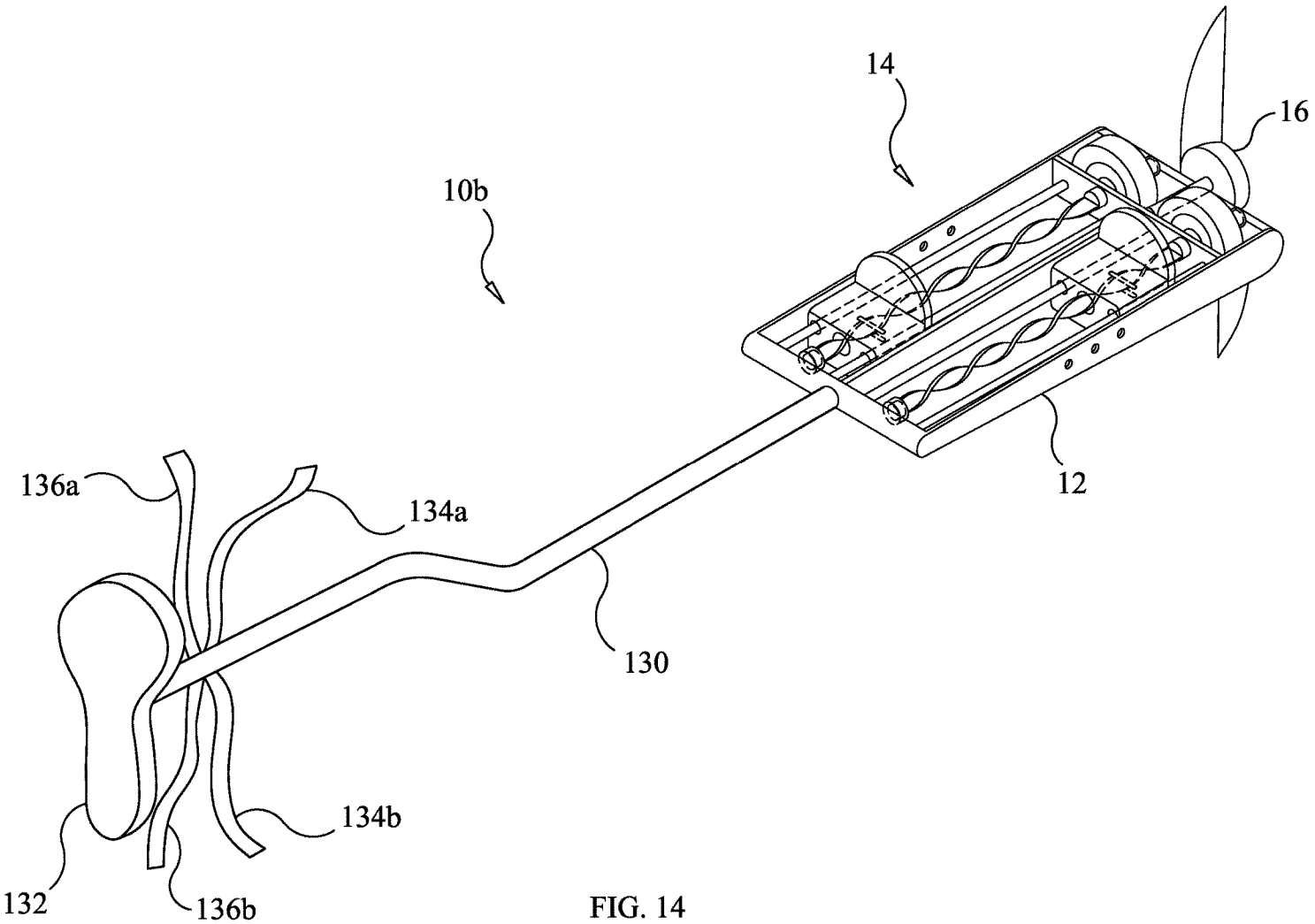
FIG. 14 is a perspective view of a human driven water propulsion device that can be used by a swimmer.

In FIG. 14 there is illustrated alternate embodiment 10*b* of the propulsion device that is configured for use by a swimmer. Propulsion device 10*b* includes the drive 14 that is supported by chassis 12 discussed above. Propulsion device 10*b* further includes a post 130 that is attached chassis 12 at an end opposite of the propeller 16 and extends outwardly therefrom in a direction that is generally parallel to the chassis. A seat 132 is mounted to the opposite end of the post 130. While not shown, the post can be constructed so that its length may be adjusted to moveably position the seat 132 toward and away from the chassis in order to accommodate people with different leg lengths.

The propulsion device 10*b* also includes two sets of thigh straps, the first set having straps 134*a* and 134*b*, and the second set having straps 136*a* and 136*b*. In use, these thigh straps are used to help secure the propulsion device 10*b* to a user. Particularly, straps 134*a* and 134*b* are wrapped around one thigh and secured to one another, and straps 136*a* and 136*b* are wrapped around the other thigh and secured to one another. The thigh straps may be constructed of an elastic-type material allowing the straps to extend and contract with the motion of the user's legs.

In use, the seat 132 is positioned between the user's legs and in the crotch region with the bar 130 extending toward the user's feet. Thigh straps are secured to the user's thighs and the user's feet are positioned on the pedals and retained by straps. The user would then pedal as described above to drive the propeller and propel him or her through the water.

A number of embodiments of the present invention have been described. Nevertheless, it will be understood that various modifications may be made without departing from the spirit and scope of the invention. Accordingly, other embodiments are within the scope of the following claims.

What is claimed is:

1. A human driven water propulsion device for attachment to a watercraft, the propulsion device comprising:

a propeller;

a human powered drive coupled to said propeller for driving said propeller;

a chassis, said propeller and said human powered drive connected to and supported by said chassis; and said chassis rotatably mounted for rotation between a first position where said propeller is faced in a forward direction and a second position where said propeller is faced in a rearward direction.

2. The propulsion device of claim 1, wherein said human powered drive comprises:

a first helical drive shaft;

a first foot pedal slidably engaged with said first helical drive shaft;

a second helical drive shaft; and a second foot pedal slidably engaged with said second helical drive shaft.

3. The propulsion device of claim 2, wherein each of said first and said second pedals includes first and second foot engagements that are disposed on opposite sides of said pedal.

4. The propulsion device of claim 1, further comprising:

a seat frame; and first and second arms each having a first end connected to said seat frame and a second end connected to said chassis.

5. The propulsion device of claim 4, wherein each of said first and second arms have an extendable length.

6. The propulsion device of claim 4, wherein each of said first and second arms have an upper arm member, a lower arm member, and an elbow joint pivotally connecting said upper arm member to said lower arm member.

7. The propulsion device of claim 4, further comprising:

first and second rotation joints connected to opposite sides of said chassis; and wherein said first end of said first arm is coupled to said first rotation joint and said first end of said second arm is coupled to said second rotation joint; and wherein said chassis is rotatably mounted by said first and second rotation joints.

8. The propulsion device of claim 7, further comprising:

first and second pivot joints;

said first pivot joint coupling said first end of said first arm to said first rotational joint; and said second pivot joint coupling said second end of said second arm to said second rotational joint.

9. The propulsion device of claim 4, wherein said seat frame has a rearwardly facing opening into which is removably disposable a structure of the watercraft to secure said seat frame to the watercraft.

10. The propulsion device of claim 4, further comprising:

a clamp attached to the upper arm member of each of said first and second arms.

11. A human driven water propulsion device for use by a swimmer, the propulsion device comprising:

a propeller;

a human powered drive coupled to said propeller for driving said propeller;

a chassis, said propeller and said human powered drive connected to and supported by said chassis;

a post connected at a first end to said chassis and extending outwardly therefrom;

a seat connected to a second end of said post; and first and second sets of thigh straps.

12. The human drive water propulsion device of claim 11, wherein said human powered drive comprises:

a first helical drive shaft;

a first foot pedal slidably engaged with said first helical drive shaft;

a second helical drive shaft; and a second foot pedal slidably engaged with said second helical drive shaft.

* * * * *